United States Patent [19]

Sandstad

[11] Patent Number: 4,915,156

[45] Date of Patent: Apr. 10, 1990

[54] GATE BREAKER

[76] Inventor: August Sandstad, Möllebakken 59, N-3250 Larvik, Norway

[21] Appl. No.: 247,363

[22] Filed: Sep. 21, 1988

[30] Foreign Application Priority Data

Jan. 21, 1987 [NO] Norway ..... 870246
Dec. 16, 1987 [WO] PCT Int'l Appl. ... PCT/NO87/0080

[51] Int. Cl.[4] ..... B22D 31/00

[52] U.S. Cl. ..... 164/265; 29/527.6; 225/103

[58] Field of Search ..... 164/265; 29/527.6; 225/103, 105, 93

[56] References Cited

U.S. PATENT DOCUMENTS 3,256,572 6/1966 Fisher ..... 164/265

FOREIGN PATENT DOCUMENTS 240204 8/1969 U.S.S.R. ..... 164/265

*Primary Examiner*—Hien H. Phan
*Attorney, Agent, or Firm*—Haugen and Nikolai

[57] ABSTRACT

A gate breaker, for the finishing of cast iron, consisting of a hydraulic cylinder which is operatively connected to a processing unit, preferably a wedge, at one end at least. The hydraulic cylinder is suspended from a circular clamp (29) with an internal semicircular track for two or more rollers (27) connected to the hydraulic cylinder. Between the hydraulic cylinder of the tool unit and the rollers (27) there is a pivot which permits pivotal movement of the gate breaker about a transverse axis of the unit.

12 Claims, 3 Drawing Sheets

GATE BREAKER

BACKGROUND OF THE INVENTION

This invention relates to a gate breaker, and more particularly a gate breaker for finishing cast iron, consisting of a tool unit with a hydraulic cylinder and a processing unit such as a wedge operatively connected to the hydraulic cylinder, where the hydraulic cylinder is mounted in a linked system and provided with handles to facilitate maneuvering it.

The present means of breaking forged cast iron involves the use of different types of manual equipment, particularly sledge hammers and wedges.

One object of the invention is to devise a means of breaking forged products using a hydraulic wedge mounted in a manner that makes it simple to use. A specific objective is to devise a means of mounting the cylinder and wedge to facilitate movement and operation of a hydraulic wedge tool, rather than using static, virtually immobile cast iron products.

SUMMARY OF THE INVENTION

To achieve these and other objects, there is provided a gate breaker for the finishing of cast iron. The breaker consists of a tool unit with a hydraulic cylinder and a processing unit such as a wedge operatively connected to the hydraulic cylinder. The hydraulic cylinder is mounted in a linked system and has a handle for maneuvering the same. A suspension supports the hydraulic cylinder, including a circular clamp with an internal semicircular or arcuate track. The track guides the travel of two or more rollers mounted with respect to the tool unit. A pivot between the tool unit and the rollers permits movement across the longitudinal axis of the unit, i.e. pivoting of the cylinder about a transverse axis.

IN THE DRAWINGS

Other advantageous features of the invention are stated in the dependent claims, and can be appreciated from consideration of the detailed description along with the accompanying drawings, in which:

DETAILED DESCRIPTION OF THE PREFERRED EMBODIMENT

Figure 1:
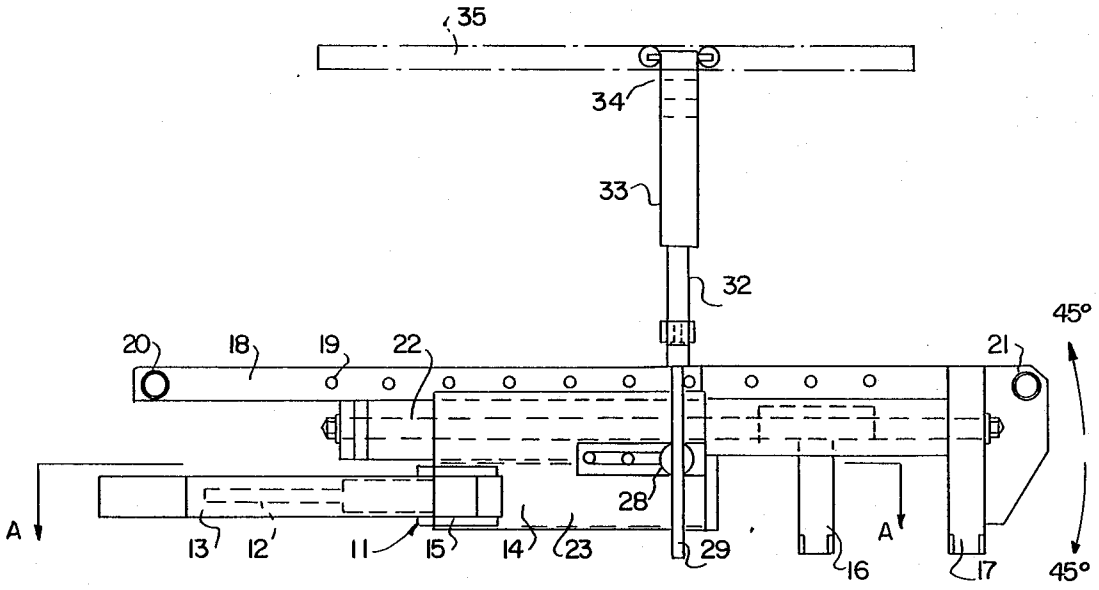
FIG. 1 shows a side perspective of a gate breaker designed in accordance with the invention.
Figure 2:
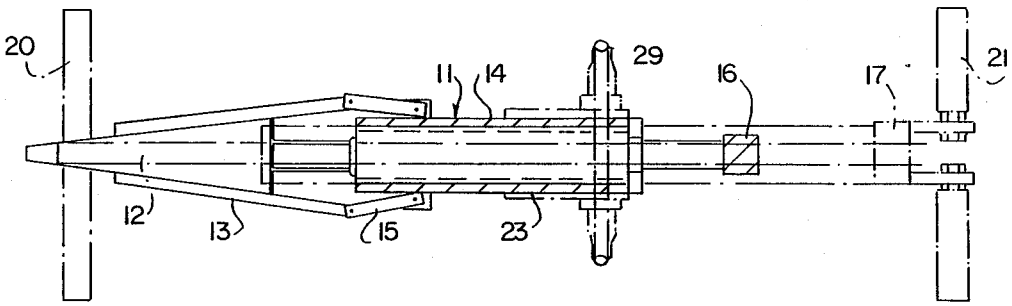
FIG. 2 shows a section along line A—A in FIG. 1.
Figure 3:
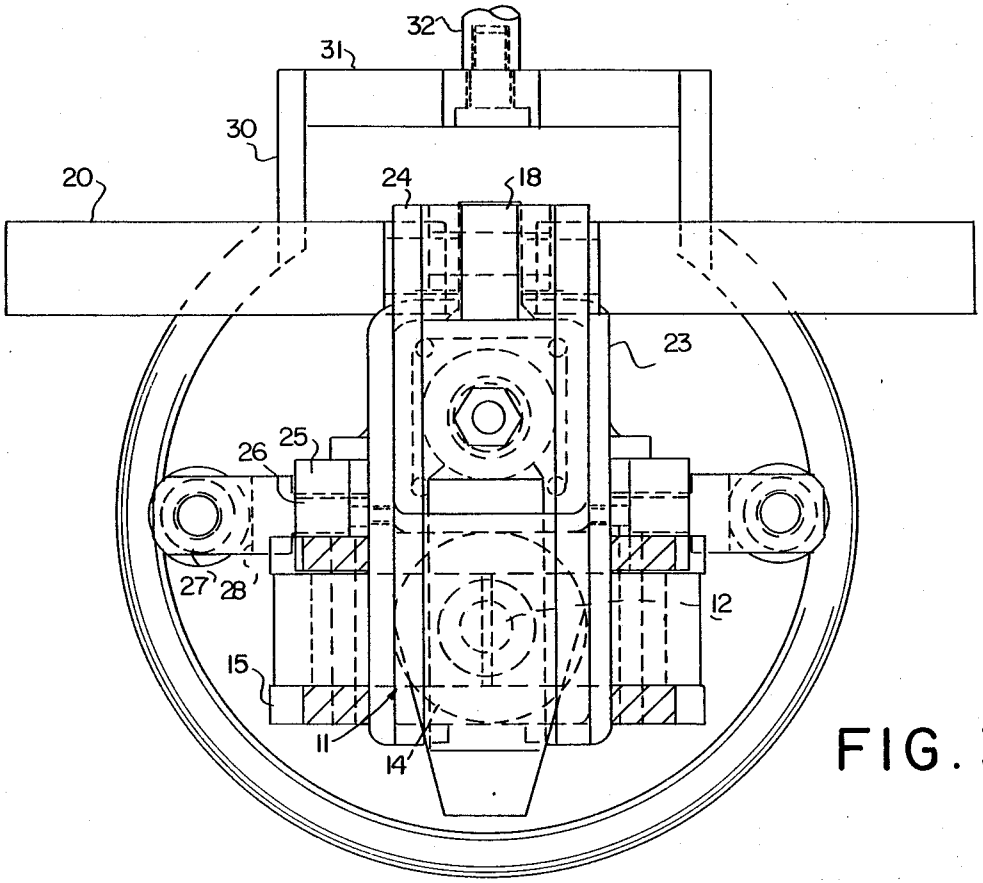
FIG. 3 shows a partial end section of the handle in the gate breaker of FIG. 1.

FIGS. 1 and 2 show the main component, a hydraulic cylinder 11 which works together with a wedge 12 inserted between a pair of breaking brackets or "wedge breakers" 13 which are linked together with the cylinder's housing 14 by means of a pair of short hinged brackets 15.

A piston rod extends through the cylinder so that at one end there is a pressure block 16 that forms a jaw together with a counter block or support unit 17.

The cylinder housing 14 is attached to a longitudinal support rod 18 which can be moved along a row of slots 19. There are lateral handles 20 and 21 respectively attached to each end of the support rod. A guide rod 22 for directing the pressure block 16 is located between the support rod 18 and the cylinder housing 14.

The hydraulic cylinder 11 with its attached working parts and the support rod 18 constitute a working unit which is slotted into a mobile linked system as described below. The cylinder housing 14 and the support rod 18 are joined by an attachment bracket 23. Bracket 23 forms a hollow profile where the support rod is inserted at the upper edge, between two attachment rails 24 with a number of holes in them. The attachment bracket 23 supports two bushings 25 which are positioned coaxially on each side of the attachment bracket. A pivot 26 is inserted in an appropriate manner in the bushing 25. At each of its free ends, this pivot 26 supports a roller 27 in a yoke 28. The rollers 27 are held in an omega-shaped steel circular ring 29 with an opening at the top. This ring 29 has two attachment lugs 30 protruding upwards which are linked by a support clamp 31. The supporting clamp 31 is fixed so that it can pivot on a vertical axis with respect to the lower end of a piston rod 32 supported by a hydraulic cylinder 33. In the example, the hydraulic cylinder 33 is attached to a trolley 34 which can be moved along a lateral rail 35.

The tool unit moves in the following manner: it can be pushed along the rail 35; it can rotate on a vertical axis around the piston rod 32; and it can rotate on its own longitudinal axis by means of the rollers 27.

Finally, it can be tipped or pivoted about a transverse or lateral axis by means of the pivots 26.

The tool unit is consequently suspended in a kind of universal joint and is thereby movable freely in relation to a piece of cast iron which is to be finished, i.e., removed or otherwise processed.

The two ends of the tool unit can be used as required, either to exercise wedging motion in narrow gaps, or to squeeze or press with the jaws 16 and 17, which can be moved both towards and away from each other.

In addition to the handles 20 and 21, equipment (known in the art and thus not illustrated) is necessary for maneuvering the hydraulic system.

What is claimed is:

1. In a gate breaker for finishing cast iron, consisting of a tool unit with a first hydraulic cylinder, a processing unit operatively connected to the first cylinder and extended from one end of the first cylinder, said first hydraulic cylinder being mounted in a linked system and having a handle to facilitate the maneuvering of it, the improvement comprising:

a means for suspending the tool unit, including a circular clamp with an internal semicircular track, at least two rollers mounted with respect to the tool unit and movable along said track to permit rotation of said tool unit about a longitudinal axis thereof, and a pivot means between the tool unit and the rollers for permitting pivoting of said tool unit about a transverse axis.

2. The gate breaker of claim 1 further characterized in that said circular clamp is mounted to pivot on a vertical axis.

3. The gate breaker of claim 2 further characterized in that said means for suspending the tool unit include a vertically disposed second hydraulic cylinder for adjusting the horizontal position of said tool unit.

4. The gate breaker of claim 2 further characterized to include a support rod, said tool unit being longitudinally adjustably suspended from said support rod.

5. The gate breaker of claim 4 further characterized in that said means for suspending the tool unit include a vertically disposed second hydraulic cylinder for adjusting the horizontal position of said tool unit.

6. The gate breaker of claim 4 further characterized as including a piston rod extended axially of said first hydraulic cylinder, a pressure block operatively connected to said piston rod at an end thereof located outside of said first hydraulic cylinder, and a counter block integral with said support rod and axially aligned with said first hydraulic cylinder, said pressure block and counter block cooperating to form a jaw.

7. The gate breaker of claim 6 further characterized in that said means for suspending the tool unit include a vertically disposed second hydraulic cylinder for adjusting the horizontal position of said tool unit.

8. The gate breaker of claim 1 further characterized to include a support rod, said tool unit being longitudinally adjustably suspended from said support rod.

9. The gate breaker of claim 8 further characterized as including a piston rod extended axially of said first hydraulic cylinder, a pressure block operatively connected to said piston rod at an end thereof located outside of said first hydraulic cylinder, and a counter block integral with said support rod and axially aligned with said first hydraulic cylinder, said pressure block and counter block cooperating to form a jaw.

10. The gate breaker of claim 9 further characterized as that said means for suspending the tool unit include a vertically disposed second hydraulic cylinder for adjusting the horizontal position of said tool unit.

11. The gate breaker of claim 8 further characterized as that said means for suspending the tool unit include a vertically disposed second hydraulic cylinder for adjusting the horizontal position of said tool unit.

12. The gate breaker of claim 1 further characterized in that said means for suspending the tool unit include a vertically disposed second hydraulic cylinder for adjusting the horizontal position of said tool unit.

* * * * *